US006710268B2

(12) United States Patent
Roos

(10) Patent No.: US 6,710,268 B2
(45) Date of Patent: Mar. 23, 2004

(54) DEVICE FOR MATRIX SWITCHING

(75) Inventor: Sture Góste Roos, Bergshamra (SE)

(73) Assignee: Telefonaktiebolagot LM Ericsson (publ), Stockholm (SE)

( * ) Notice: Subject to any disclaimer, the term of this patent is extended or adjusted under 35 U.S.C. 154(b) by 0 days.

(21) Appl. No.: 10/176,397

(22) Filed: Jun. 21, 2002

(65) Prior Publication Data

US 2003/0000813 A1 Jan. 2, 2003

Related U.S. Application Data

(63) Continuation-in-part of application No. 09/982,251, filed on Oct. 16, 2001.
(60) Provisional application No. 60/245,735, filed on Nov. 3, 2000.

(30) Foreign Application Priority Data

Nov. 3, 2000 (EP) ..... 00850187
Nov. 2, 2001 (SE) ..... PCT/SE01/02410

(51) Int. Cl.[7] ..... H01H 9/54
(52) U.S. Cl. ..... 200/1 R; 200/11 A; 200/11 R; 200/19.06; 335/106
(58) Field of Search ..... 200/1 R, 11 A, 200/11 P, 11 TL, 11 TW, 11 DA, 11 R, 19.06, 19.07, 19.11, 19.18; 335/106, 107, 108, 118

(56) References Cited

U.S. PATENT DOCUMENTS

| | | | | |
|---|---|---|---|---|
| 1,309,231 A | * | 7/1919 | Adams | |
| 2,168,373 A | * | 8/1939 | Thompson | 200/92 |
| 2,281,472 A | * | 4/1942 | Betulander | 179/27.5 |
| 2,965,725 A | | 12/1960 | Mason | |
| 3,001,041 A | | 9/1961 | Bakels | |
| 3,383,478 A | | 5/1968 | Mandel | |
| 3,755,765 A | * | 8/1973 | Reaves, Jr. | 335/118 |
| 3,962,642 A | * | 6/1976 | Kitamura et al. | 325/455 |
| 4,684,855 A | * | 8/1987 | Kallos | 318/254 |
| 4,954,674 A | * | 9/1990 | Roos | 200/175 |

FOREIGN PATENT DOCUMENTS

| | | |
|---|---|---|
| DE | 330 269 | 12/1920 |

* cited by examiner

*Primary Examiner*—Elvin Enad
*Assistant Examiner*—K. Lee
(74) *Attorney, Agent, or Firm*—Nixon & Vanderhye, P.C.

(57) ABSTRACT

A switching device selectively connects a number of incoming electrical lines with a number of outgoing electrical lines. The incoming and outgoing lines are each connected to individual contact surfaces, respectively. The contact surfaces are arranged in concentric ring-shaped areas. A maneuvering unit is arranged in the center of the ring-shaped areas. A driver rotates the maneuvering unit. A number of contact elements are positioned by the maneuvering unit, to obtain electrical contact between specific, contact surfaces.

11 Claims, 9 Drawing Sheets

DEVICE FOR MATRIX SWITCHING

This application is a continuation in part of Ser. No. 09/982,251 filed Oct. 16, 2001, and claims benefit of Provisional of application Ser. No. 60/245,735 filed Nov. 3, 2000.

TECHNICAL FIELD

The present invention relates to a switching device for optional connection of a number of incoming electrical lines with a number of outgoing electrical lines such as for handling of telephone lines in access networks.

BACKGROUND

Several different designs of matrix crosspoint switching devices are known and have been used for different applications. Matrix crosspoint switching devices are generally designed with a plurality of incoming conductors and a plurality of outgoing conductors, where they form a matrix with a plurality of crosspoints.

In networks such as for example telephony it is desired to have automatic, remotely controlled crosspoint switches in order to connect cables in for example buildings and distribution cabinets. As regards telephone stations there is also a desire to have automatic switching between different types of service units and for connecting telephone subscribers.

A type of matrix crosspoint switching device utilising balls as contact elements at the crosspoints is disclosed in U.S. Pat. No. 4,954,674. The device comprises a connection block with a plurality of cavities containing crosspoints of the plurality of contact pairs, where each cavity comprises an electrically conductive ball and an electrically insulating ball. The balls are positioned such as to provide electrical contact or no electrical contact between incoming conductor pairs in one direction and outgoing conductor pairs in the outgoing direction with the aid of operating rods which transmit the operating force from one connection site to an adjacent operating site.

The device according to U.S. Pat. No. 4,954,674 significantly reduces the size of a crosspoint matrix switching device in contrast to the conventional mechanical relaying devices. However it comprises a large number of elements that are movable with respect to contact surfaces and to each other, which complicates the manufacture of the device. It is further not an ideal solution as regards flexibility and size in view of the increasing demands on reducing the size, i e packing density, and high flexibility. A matrix switching device is needed that fulfils these demands and is, inexpensive.

SUMMARY

The object of the present invention is to provide a switching device capable of optionally connecting a number of incoming electrical lines with a number of outgoing electrical lines in a way that is space saving, flexible and inexpensive.

The benefits of the present invention are several. By arranging electrical contact surfaces on a cylindrical surface, which contact surfaces are electrically connected to the incoming and outgoing electrical lines, and by providing an axially symmetrical rotatable body adjacent said cylindrical arranged with contact elements, it is possible to provide electrical contact between selected incoming lines and selected outgoing lines by rotating the symmetrical body. Because the whole circumference, i e 360°, of the cylindrical surface may be used, it may be divided into a large number of contact points, thereby providing a large number of crosspoints between the incoming and outgoing lines. The contact surfaces may also be divided in the longitudinal direction of the cylindrical surface, facilitating the arrangement of the crosspoints in that the contact surfaces of the incoming lines are arranged over or under the contact surfaces of the outgoing lines as seen in the longitudinal direction, and designing the contact elements so that they are capable of bridging the gap between selected contact surfaces of the incoming lines with selected contact surfaces of the outgoing lines.

The benefits of the present invention are several. By arranging electrical contact surfaces on a cylindrical surface, which contact surfaces are electrically connected to the incoming and outgoing electrical lines, and by providing an axially symmetrical rotatable body adjacent said cylindrical arranged with contact elements, it is possible to provide electrical contact between selected incoming lines and selected outgoing lines by rotating the symmetrical body. Because the whole circumference, i e 360°, of the cylindrical surface may be used it may be divided into a large number of contact points, thereby providing a large number of crosspoints between the incoming and outgoing lines. The contact surfaces may also be divided in the longitudinal direction of the cylindrical surface, facilitating the arrangement of the crosspoints in that the contact surfaces of the incoming lines are arranged over or under the contact surfaces of the outgoing lines as seen in the longitudinal direction, and designing the contact elements so that they are capable of bridging the gap between selected contact surfaces of the incoming lines with selected contact surfaces of the outgoing lines.

The design of the switching unit according to the invention provides a very compact solution. The symmetrical body is preferably driven by an electric motor, and more preferably by a stepper motor, which enables and facilitates the use of a plurality of contact points around the circumference of the cylindrical surface. The solution requires very little power consumption for the switching, and no power consumption when in the required contact position.

As an alternative design, the switching unit may be arranged such that the contact surfaces and contact points are arranged on a plane, for example a circuit board, in concentric rings or areas, that a drive means is arranged in the center of the rings and that contact elements are arranged by the drive means such that they provide a bridge between the contact surfaces and selected contact points.

The switching unit is further preferably provided with position signalling means, enabling a precise knowledge of the rotational position of the symmetrical body in relation to the cylindrical surface, and thus the crosspoints of the lines. The switching unit may further be provided with a home or reference position and memory means for storing the number of steps that the unit has moved.

The switching unit according to the invention may also be connected to further switching units, which greatly enhances the flexibility of the switching device. Preferably either the incoming or the outgoing lines are connected through all switching units and a set of outgoing or incoming lines respectively are arranged to a respective switching unit thereby providing a matrix crosspoint switching device, where each switching device is arranged with its own drive means for selectively connecting its set of lines with the through-going lines.

The sizes of the drive means available today enables a very compact design of the switching units, in the order of 20×20×10 mm for each unit. Preferably one unit or several interconnected units are connected to a printed circuit board comprising the necessary control means for activating the motors and to position the symmetrical body in order to obtain the required contacts between the incoming and outgoing lines. Further, if several switching units are interconnected, a connection block is arranged for directing the lines down to the circuit board, thereby reducing the wiring and facilitating the design and layout of the circuit board.

Further aspects of the present invention and advantages with it will become apparent from the following detailed description of the invention and from the accompanying drawings.

BRIEF DESCRIPTION OF THE DRAWINGS

In the following detailed description of the invention, reference will be made to the accompanying drawings, of which

DETAILED DESCRIPTION

Figure 1:
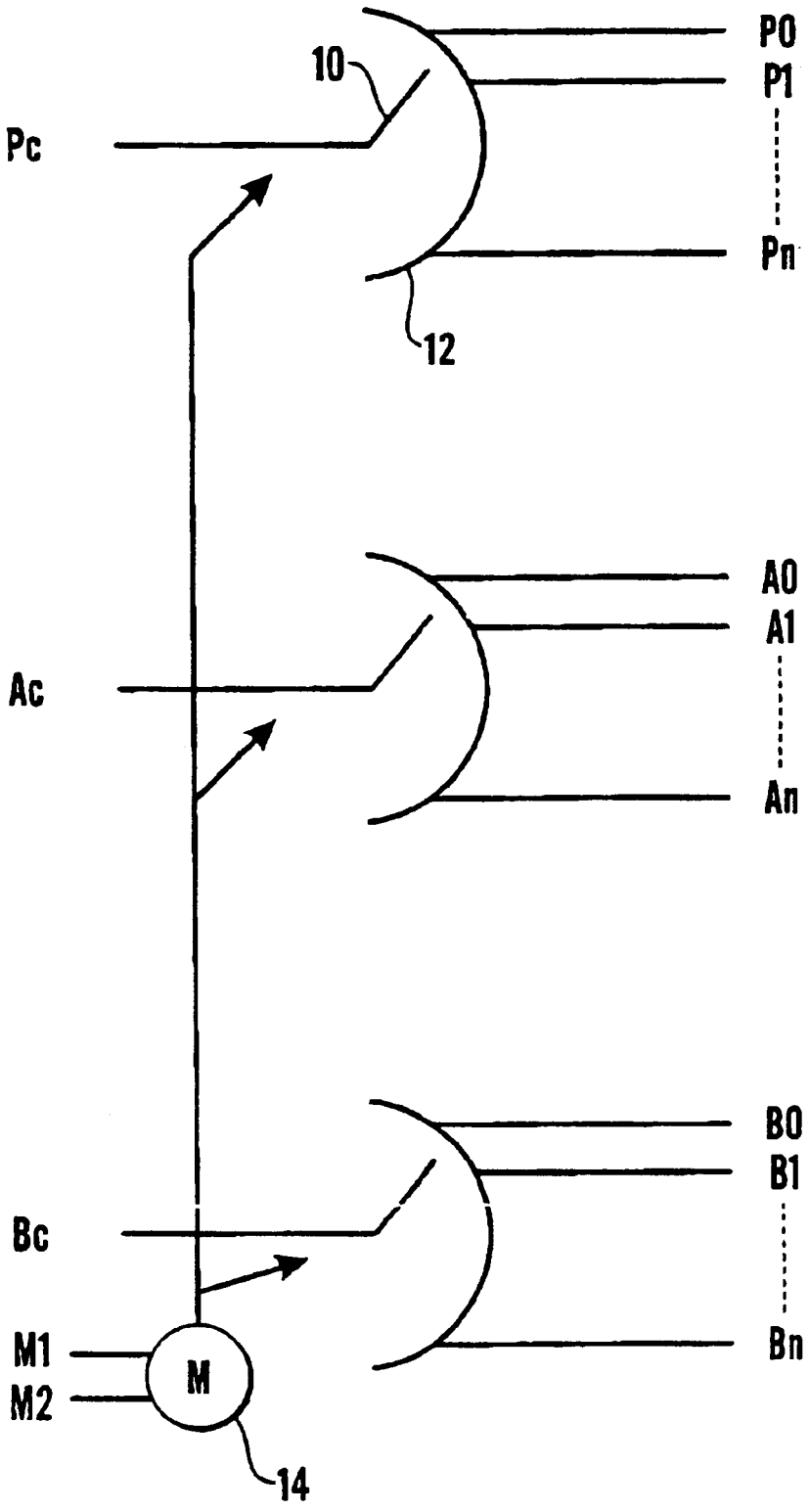
FIG. 1 shows symbolically the function of the present invention.

In FIG. 1, shows two incoming lines $A_C$ and $B_C$, for example a pair of telephone lines, and a positioning signal line $P_C$. Each incoming line and the positioning signal line may be connected by rotating a positioner 10 to a number outgoing lines P0–Pn, A0–An, B0–Bn, where n is the maximum number of outgoing lines selected for the actual application. The contact points of the outgoing lines are positioned on a circular curve 12. The positioner is operated by an electric motor 14, preferably a stepper motor, although any motor capable of moving the positioner between the separate contact points may be employed. Each positioner is jointly driven by the motor, which means that all positioners are moved for example one The present invention will now be described in connection with the accompanying increment when the motor is stepped one increment.

Figure 2:
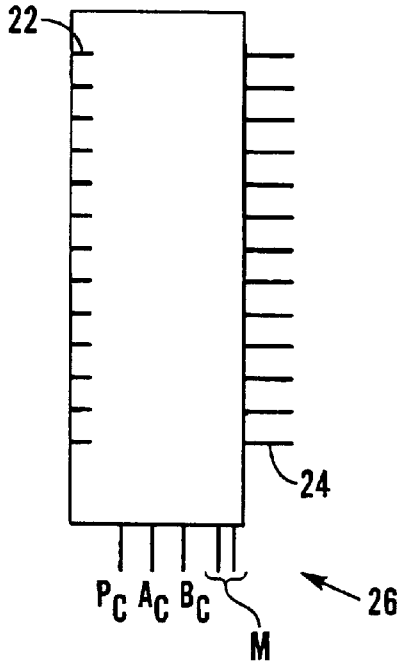
FIG. 2 shows a side view of a switching unit of the present invention.
Figure 3:
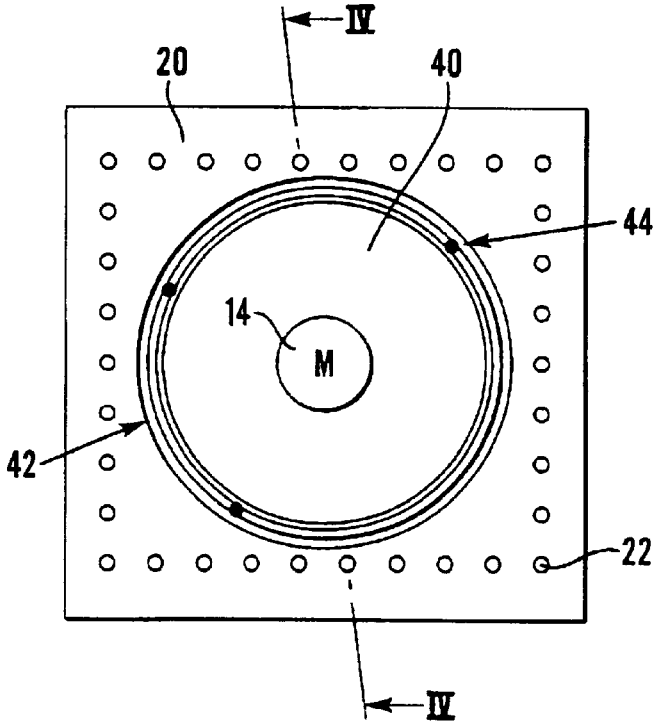
FIG. 3 shows a front view of the switching unit of FIG. 2.
Figure 4:
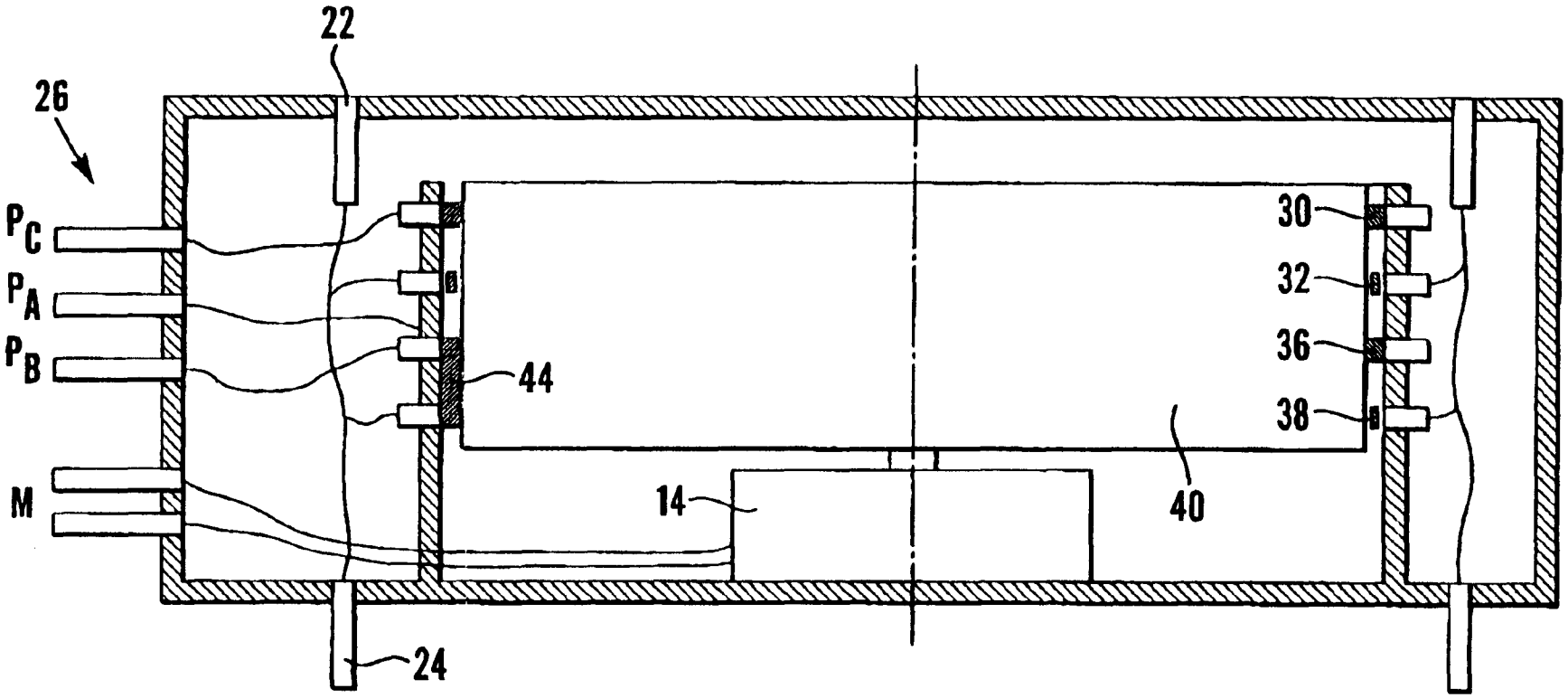
FIG. 4 shows a cross sectional view along line IV—IV of FIG. 3.

FIGS. 2 to 4 show an example of an embodiment of a switching unit utilising the principle of FIG. 1. It comprises a housing 20 of a generally rectangular shape. The left side surface of the housing, as seen in FIG. 2, is arranged with a plurality of contact holes 22 arranged in a certain pattern and the right side surface is arranged with the same number of contact pins 24 and the same configuration as the contact holes. Each contact hole in a specific position is electrically connected to a contact pin at the corresponding position FIG. 4, thereby providing a through-going connection for the outgoing lines, as will be explained in detail below. The lower surface of the housing is arranged with a number of contact pins 26, where two of them are for the incoming lines $A_C$, $B_C$, one is for the signal line $P_C$ and least two are electrical contacts for the motor.

Figure 5:
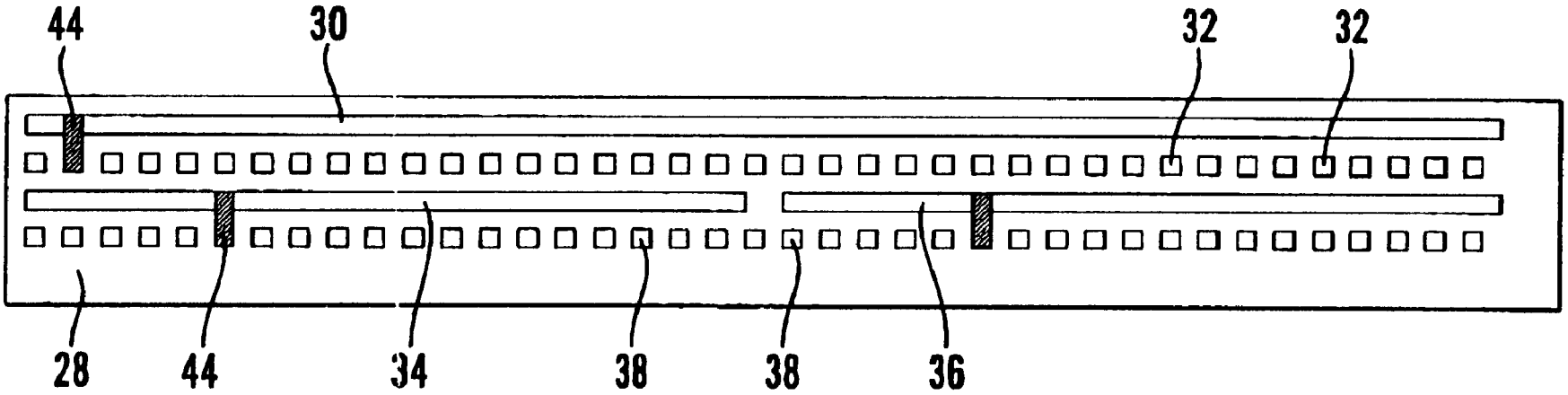
FIG. 5 shows an unfolded view of a cylindrical contact surface comprised in the switching unit of the invention.

The center of the switching unit is arranged with a circular cylindrical recess, the side surface 28 of which is arranged with electrical contact areas, FIG. 5. As seen in FIG. 5, which is an unfolded view of the side surface, it comprises a contact path 30, the uppermost part, which is electrically connected to the contact pin for the signal line $P_C$. This contact path stretches a full 360° around the cylindrical recess. Below that contact part, a plurality of contact points 32 are arranged in a row, with a certain space between each contact point. These contact points are each connected to one of the through-going connections 22, 24, FIG. 4. Below these are two contact paths 34, 36 arranged in a row after each other and with some land between them at two points, whereby each contact path stretches somewhat less than 180° around the circumference of the cylindrical recess. Each of these contact paths is respectively connected to one of the incoming lines $A_C$, $B_C$.

Below these contact paths are a plurality of contact points 38, corresponding to the number of contact points of the plurality of upper contact points, and with a corresponding position in a vertical direction as seen in FIG. 4. These contact points are each connected to a specific outgoing connection, where the contact point in the lower row is connected to the same connection as the contact point of the upper row positioned vertically above. The rest of the cylindrical surface has an insulating material.

In the cylindrical recess a maneuvering unit 40 is rotatably arranged, FIGS. 3 and 4. The maneuvering unit is formed as an axially symmetrical body with somewhat lesser diameter than the cylindrical recess, thereby forming a gap 42 between them. The maneuvering unit is rotatable by an electric motor 14, preferably a stepper motor. The side surface of the maneuvering unit is arranged with a plurality of holding means, corresponding to the number of contact points of the side surface of the cylindrical recess and with the same pitch as the contact points. Contact elements 44 are provided for being releasably attached to the holding means at selected locations around the circumference of the symmetrical body. The holding means are arranged such and/or the contact elements have such a configuration that only one contact pin can provide contact between the uppermost contact path and one of the plurality of contact points at the upper row at a specific location, while the other contact elements are capable of providing contact between one of the lower contact paths and a specific contact point of the lowermost row of contact points. In the embodiment shown, there is one contact element between each incoming line (contact path 34, 36) and the requested outgoing line (contact points 38), which is common in connection of telephone lines. It shall however be understood that for some applications, there might be more than one contact element for each incoming line, thereby connecting it to more than one outgoing line.

The function of the switching unit is as follows. The unit is attached to a holder, for example a printed circuit board (not shown) whereby the contact pins 26 of the incoming signals are in electrical contact with the circuit board and in turn to for example the lines of a telephone cable. The outgoing contact pins 24 are electrically connected to a number of telephone lines. The circuit board is arranged with a control unit which is capable of activating the motor in order to rotate the maneuvering unit one or more steps in order to position the contact elements in the desired positions. The control unit further provides information from the position signaling line $P_C$, in order for the control unit to keep track on the actual position of the maneuvering unit is and its contact element in relation to the contact points of the cylindrical recess. If the control unit receives a request for connecting the incoming pair of lines to certain outgoing pair of lines, the motor is activated and the maneuvering unit is rotated a number of steps in a rotational direction from its actual position until the requested contact points 38 of the outgoing lines are reached and the new connection is obtained in that the contact elements 44 bridge the gap between the contact points and the respective contact path 34. The position signal enables a control of the actual position of the maneuvering unit at any time, which thus eliminates any storage of data concerning the crosspoints connected. The switching unit may further or instead be provided with a home or reference position and the control unit may be provided with a memory in order to keep track of the number of steps that the maneuvering unit has moved from the reference position.

If the control unit receives a request for connecting the incoming pair of lines to certain outgoing pair of lines, the motor is activated and the maneuvering unit is rotated a number of steps in a rotational direction from its actual position until the requested contact points 38 of the outgoing lines are reached and the new connection is obtained in that the contact elements 44 bridge the gap between the contact points and the respective contact path 34. The position signal enables a control of the actual position of the maneuvering unit at any time, which thus eliminates any storage of data concerning the crosspoints connected.

The switching unit may further or instead be provided with a home or reference position and the control unit may be provided with memory means in order to keep track of the number of steps that the maneuvering unit has moved from the reference position.

Figure 6:
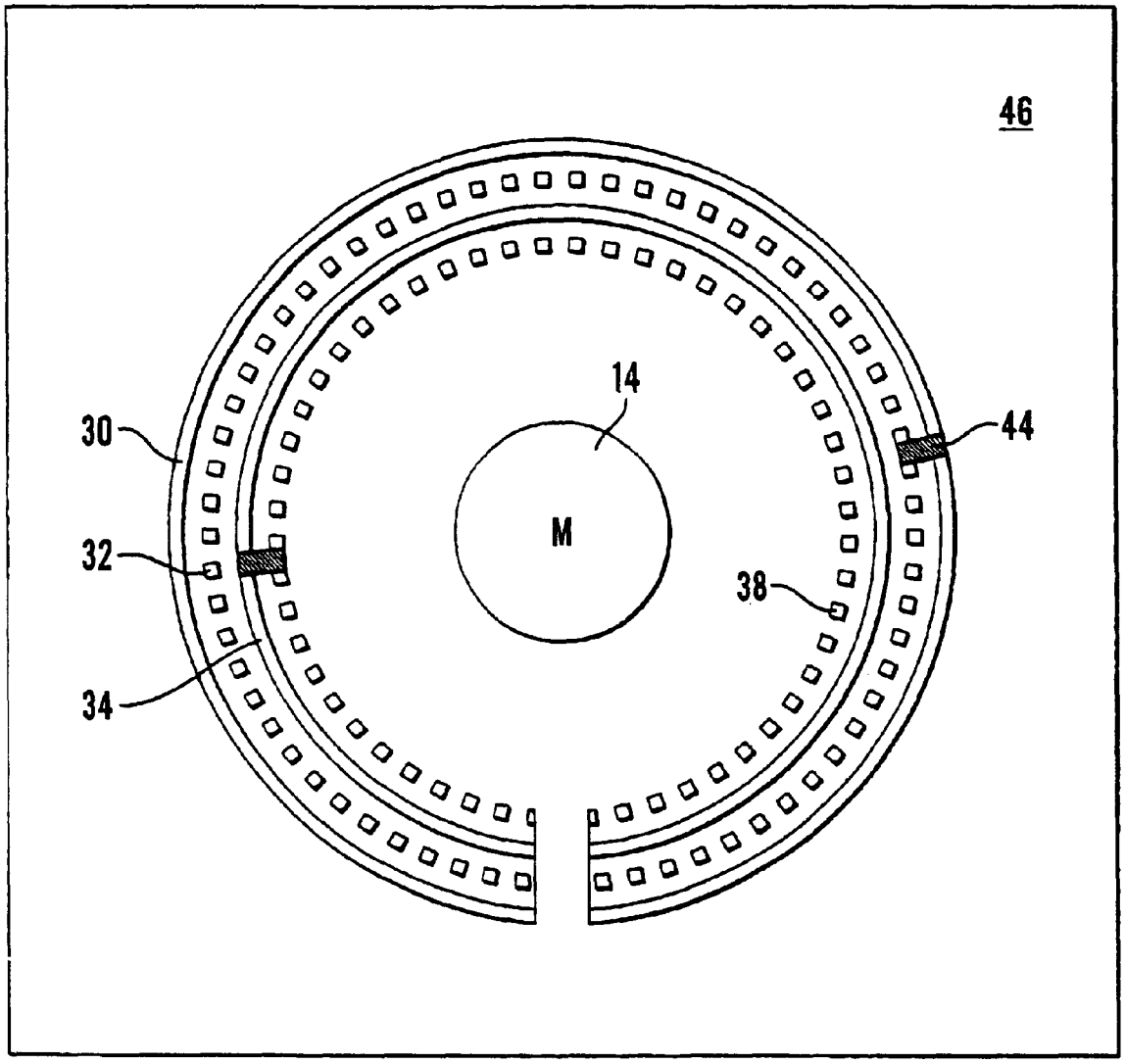
FIG. 6 shows another embodiment of the present invention.

FIG. 6 shows another embodiment of the switching unit according to the invention. Instead of a cylindrical surface, the contact paths 30, 34 and contact points 32, 38 are arranged on the same plane, for instance the surface of a circuit board 46, in concentric rings and ring-shaped areas respectively. In the center of the rings a stepper motor 14 is arranged with the same function as for the previous embodiment. To the stepper motor a maneuvering unit is arranged (not shown) rotatable above the plane. The maneuvering unit is arranged with holding means, corresponding to the number of contact points and with the same pitch as the contact points. Contact elements 44 in the form of collector shoes or the like are provided for being releasably attached to the holding means at selected locations on the maneuvering unit. The holding means are arranged and/or the contact elements have such a configuration such that only one contact pin can provide contact between the outermost contact path 30 and one of the plurality of contact points at the adjacent ring area at a specific location, while the other contact elements are capable of providing contact between the inner contact path and a specific contact point of the adjacent ring area of contact points. In order to obtain electrical contact between the different contact paths and contact points and external wiring or the like, a number of conductor bands may be arranged in the circuit board, in different layers if necessary, in a manner known to the man skilled in the art.

Figure 7:
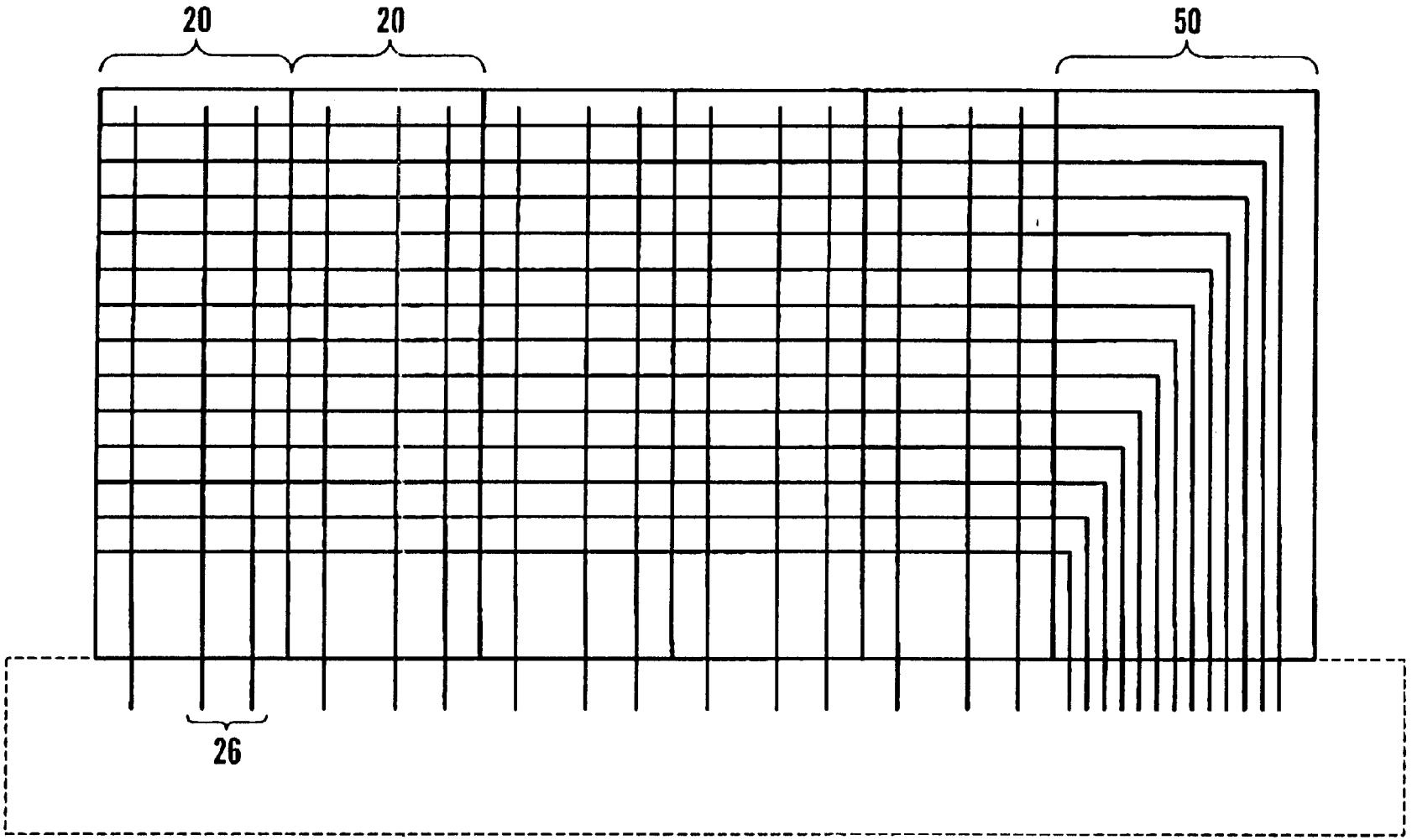
FIG. 7 shows how the switching units of FIG. 2 may be connected to each other.

FIG. 7 shows how a number of switching units 20 connected to each other, where each switching unit is arranged in the same way as described above. The units are arranged to each other so that the contact pins 24 of one unit fit into the contact holes 22 of an adjacent unit, whereby the outgoing conductors are connected through all the units. Each unit is provided with a couple of incoming lines 26 and a position signal line as well as connections for the motor. This configuration enables the connection of a plurality of incoming lines with a plurality of outgoing lines. Each unit is provided with its own motor for connecting the incoming lines of that unit with the requested outgoing lines passing through the units. The last, or first, unit is preferably attached to a connection block 50. The function of the connection block is to direct all the conductors of the outgoing lines to the printed circuit board, shown with broken lines, thus eliminating the connection of the outgoing lines of each switching unit to the circuit board, which could lead to difficulties in the layout of the circuit board.

With the embodiment shown in FIG. 6 no connection block is needed since several switching units may be arranged on a large circuit board and where the different switching units are connected by connector bands arranged in or on the circuit board. Further, several circuit boards may be interconnected by ribbon cables and the like.

By connecting a suitable number of switching units, a large crosspoint matrix is obtained, FIG. 7, where only one branch is shown, and because the units are easily connectable to each other, it provides a very flexible solution.

Figure 8:
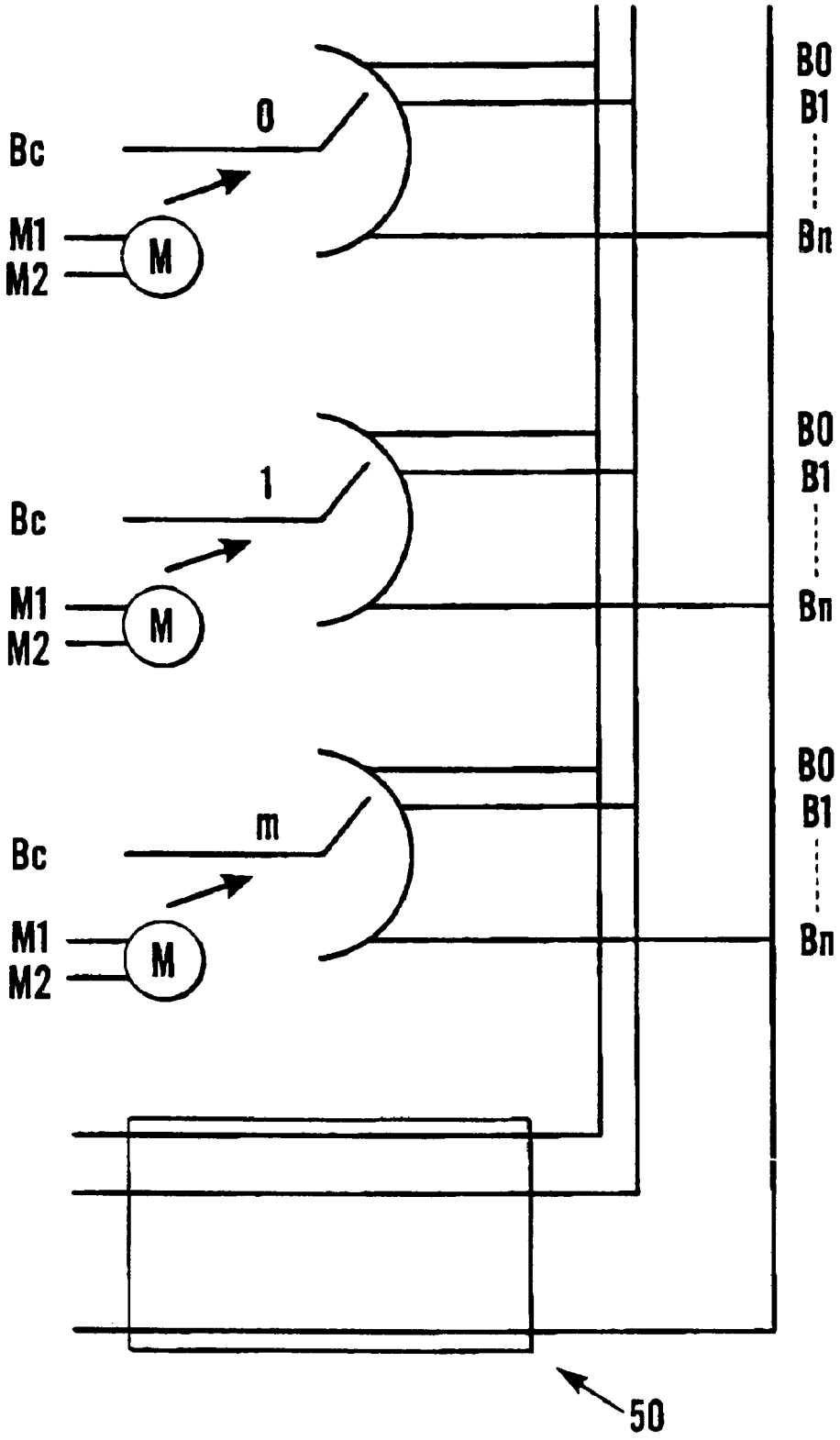
FIG. 8 shows symbolically the function of the present invention when switching units are connected to each other.
Figure 9:
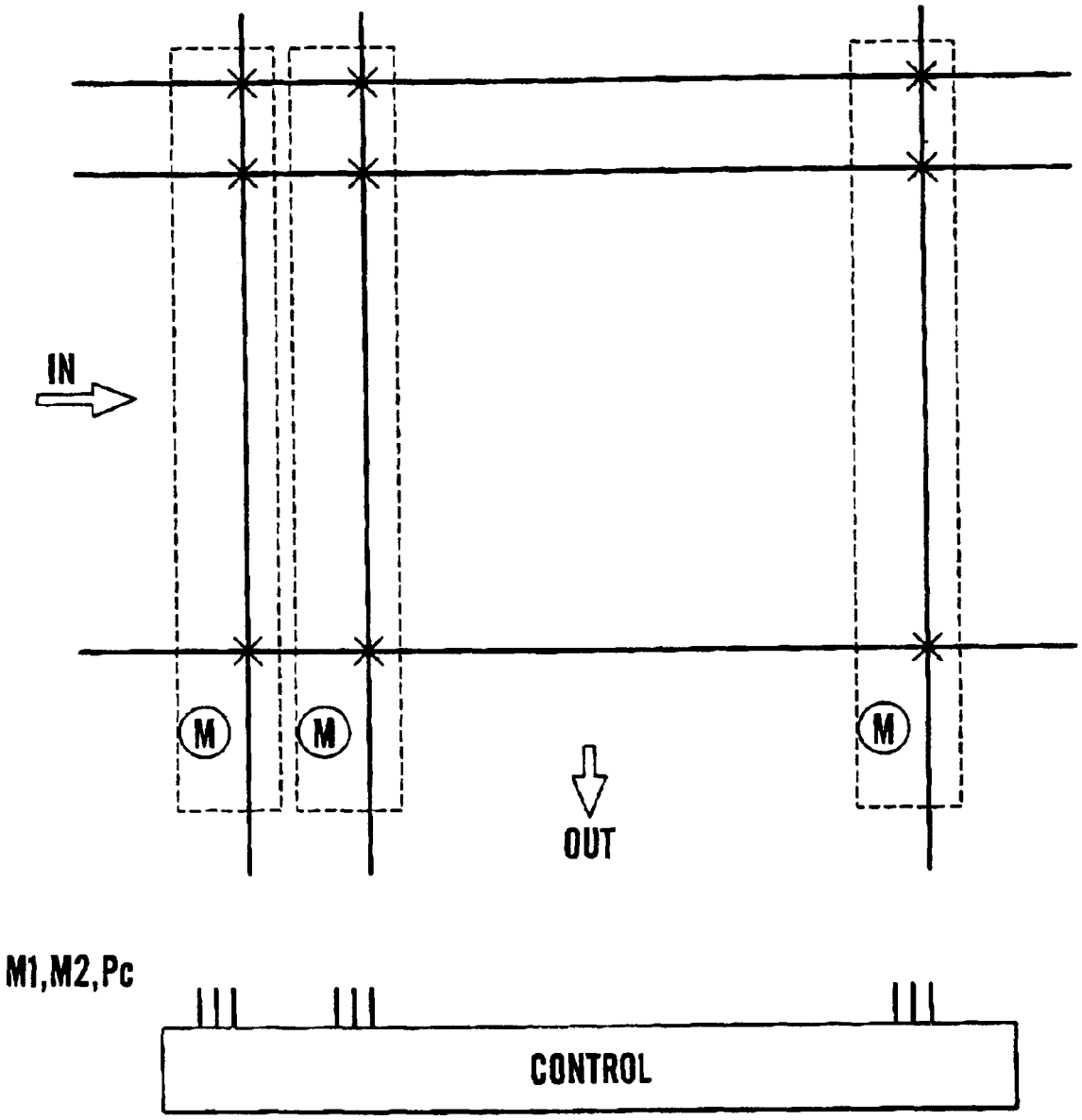
FIG. 9 shows a variant of the present invention.

It is naturally conceivable to change the position of the incoming and the outgoing lines on the switching unit, FIG. 8. One advantage with that configuration is that if switching unit fails, due for example to a break down of its motor, another outgoing line may be chosen whereby redundancy is obtained in the system.

Figure 10:
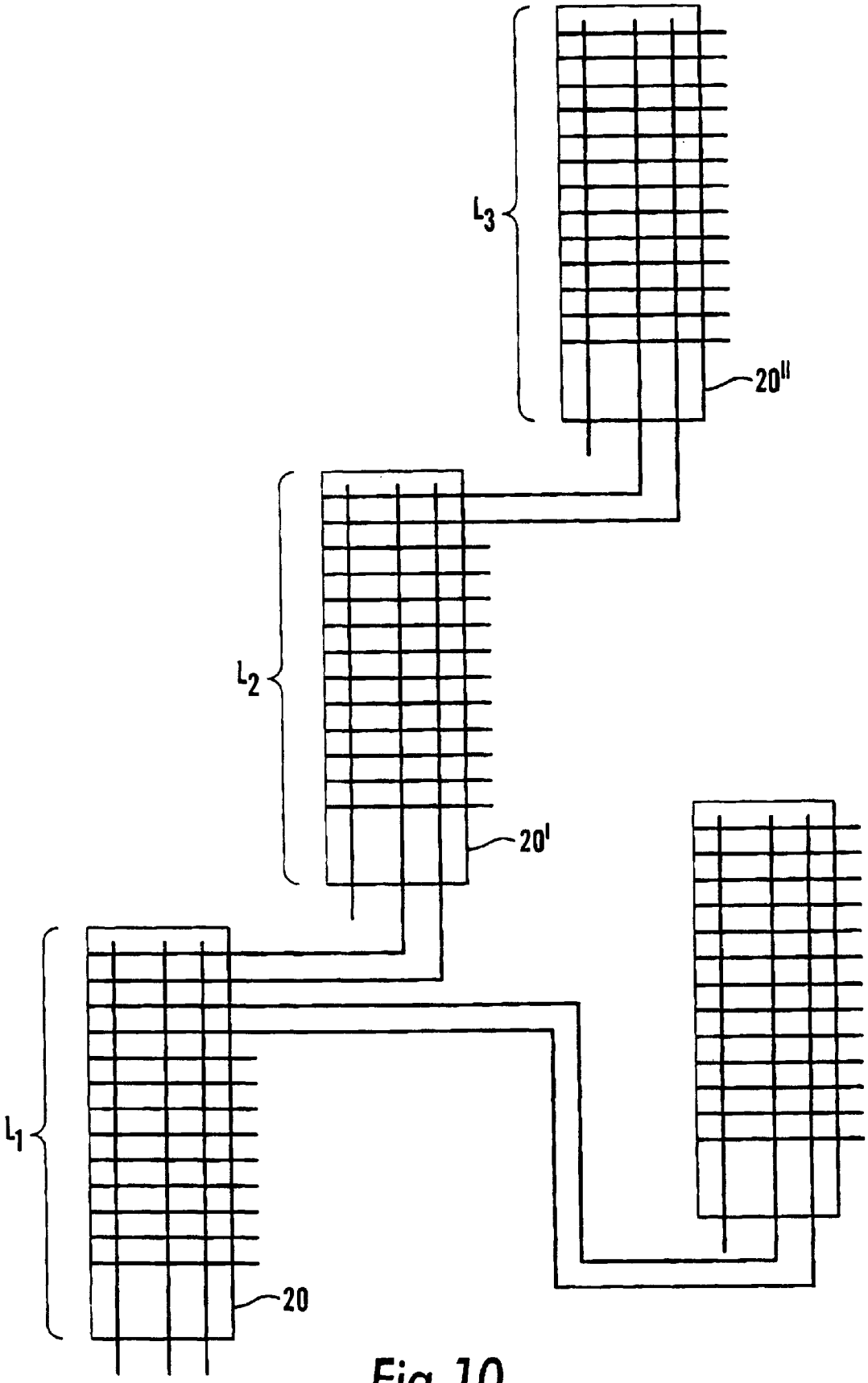
FIG. 10 shows switching units according to the invention connected in levels.

FIG. 10 shows a schematic view of connecting the switching units according to the invention in levels, in order to manage a large number of outgoing lines. On the first level L1 one switching unit 20 is shown. It is connected to the incoming lines AC and BC. The outgoing connections of the switching unit are connected to the incoming connections of a further switching unit 20' on the second level L2. In turn the outgoing connections of the second level switching unit is connected to a further switching unit 20" on the second level L3. In this way the incoming lines may be connected to a very large number of outgoing lines, thereby increasing the connection points.

Apart for the first level, only one further switching unit is shown connected to the outgoing lines of a previous unit. Of course many further switching units may be connected to a previous switching unit, as shown at the first level, thereby even further increasing the possible switching connections. Further, the switching units may connected as shown in FIG. 7, thereby increasing the number of incoming lines to a level.

When a number of switching units are connected in the manner described in connection with FIG. 10, it is necessary to arrange so that the contact elements that are moved between the actual position and the new requested position are prevented from coming in contact with the contact points that are positioned between, which contact points may be connected. Such a contact may otherwise disturb the connection. The contact elements may therefore be arranged with means capable of lifting them during movement of the maneuvering unit so that they cannot come in contact with contact points between the actual and the new position.

Another way of dealing with this is to have the control unit move the contact elements of each switching unit one at the time to a rest position between two contact points, where one of the contact points is the requested one, and when all switching units are positioned in that way, all switching units are activated and all maneuvering units are moved simultaneously to the requested adjacent contact points.

Even though the embodiments described deal with line couples, which is the common arrangement for telephone lines, it is to be understood that the present invention is equally suitable for any number of lines.

It is to be understood that the above described and shown embodiments are only to be regarded as non-limiting examples of the present invention and that it may be modified within the scope of protection.

What is claimed is:

1. System for selective connection of a plurality of incoming electrical lines with a plurality of outgoing electrical lines, comprising a plurality of switching units each including:

contact surfaces arranged in concentric ring-shaped areas on a surface of a printed circuit board, a maneuvering unit arranged in the center of said ring-shaped areas, a number of contact elements arranged on said maneuvering unit, and a driver for positioning said contact elements on said maneuvering unit to obtain electrical contact between selected contact surfaces, wherein said switching units are arranged on a printed circuit board that includes connections for electrically connecting said incoming and outgoing electrical lines and said switching units.

2. System according to claim 1, wherein said contact surfaces are arranged on a cylindrical surface, said maneuvering unit comprises an axially symmetric body arranged adjacent said cylindrical surface, and a number of contact elements are arranged on a surface of said symmetric body facing the cylindrical surface.

3. System according to claim 2, wherein the contact surfaces for the incoming lines are arranged above or under the contact surfaces for the outgoing lines as seen in a direction of a center line, and wherein the contact elements are arranged and designed for bridging the contact surfaces of the incoming and outgoing lines.

4. System according to claim 2, wherein the contact surfaces of one or both of the incoming and outgoing lines are arranged as contact points in rows along a circumference of the cylindrical surface.

5. System according to claim 2, wherein the symmetrical body is arranged with a number of fasteners for releasably holding the contact elements in a number of positions around a circumference of the symmetrical body.

6. System according to claim 1, wherein said contact surfaces are arranged on a plane in concentric ring areas and said maneuvering unit is arranged in the center of said ring areas.

7. System according to claim 6, wherein the contact surfaces of the incoming lines are arranged outside or inside the contact surfaces of the outgoing lines as seen in a radial direction, and wherein the contact elements are arranged and designed for bridging the contact surfaces of the incoming and outgoing lines.

8. System according to claim 6, wherein the contact surfaces of one or both of the incoming and the outgoing lines are arranged as contact points in rows along the ring areas of the plane surface.

9. System according to claim 1, wherein the maneuvering unit is arranged with a number of fasteners for releasably holding the contact elements in a number of positions.

10. System according to claim 2, further comprising:

a position sensing device for sensing a rotational position of the axially symmetrical body in relation to the cylindrical surface.

11. System according to claim 1, wherein the driver includes a stepper motor.

* * * * *